United States Patent [19]

Ferrigno, Jr.

[11] 4,318,094

[45] Mar. 2, 1982

[54] INTERFACE DEVICE FOR REMOTE CONTROL

[75] Inventor: William L. Ferrigno, Jr., Peacedale, R.I.

[73] Assignee: General Electric Company, New York, N.Y.

[21] Appl. No.: 95,118

[22] Filed: Nov. 16, 1979

Related U.S. Application Data

[63] Continuation of Ser. No. 701,061, Jun. 30, 1976, abandoned.

[51] Int. Cl.[3] ..... G08B 21/00

[52] U.S. Cl. ..... 340/657; 340/660; 340/664

[58] Field of Search ..... 307/235 R, 235 E, 236, 307/41, 115; 361/193; 340/657, 660, 664

[56] References Cited

U.S. PATENT DOCUMENTS

| | | | |
|---|---|---|---|
| 3,766,432 | 10/1973 | Markowitz | 317/DIG. 6 |
| 3,826,968 | 7/1974 | Visser | 340/248 P |
| 3,943,409 | 3/1976 | Brown | 340/253 S |

*Primary Examiner*—Harold I. Pitts

*Attorney, Agent, or Firm*—Paul E. Rochford; Walter C. Bernkopf

[57] ABSTRACT

An interface device for the remote control of pulse activated, mechanically held relays or master switches by control devices which have a continuous output, such as time clocks, security system devices, and thermostats. The presence of a continuous input signal is decoded by the electronic circuitry into a momentary output signal to be applied to the "on" side of a remote control relay. When the input signal is removed, the device decodes this lack of signal and produces a momentary signal to be applied to the "off" coil of the relay. Input terminals are provided with four types of input signals −120 volts AC, 12 volts DC, a contact closure, and a contact opening. Three output terminals are provided, namely, "common," "on," and "off" terminals for connection to the remote control relays. Another set of terminals can be provided to allow the use of an external power supply load with the device, by incorporating a control relay within the device capable of handling 20 amps. Also several sets of "on" and "off" output terminals which are isolated from one another can be provided.

8 Claims, 6 Drawing Figures

FIG. 1
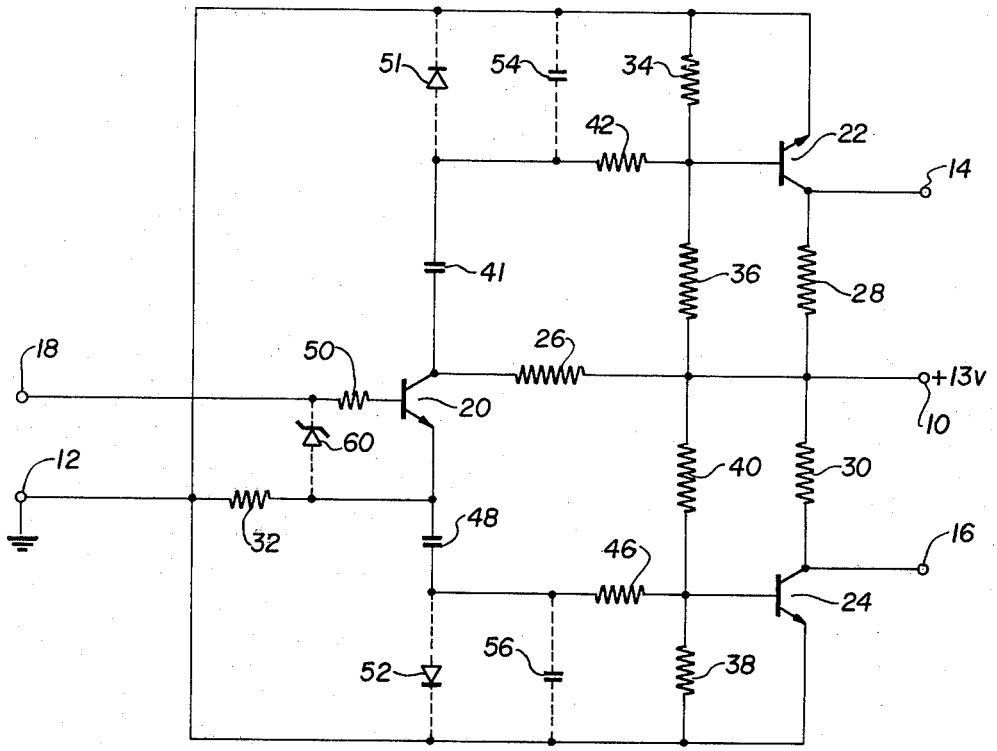
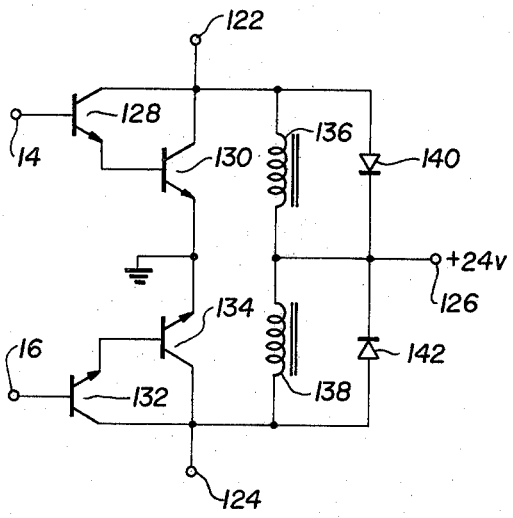
FIG. 3
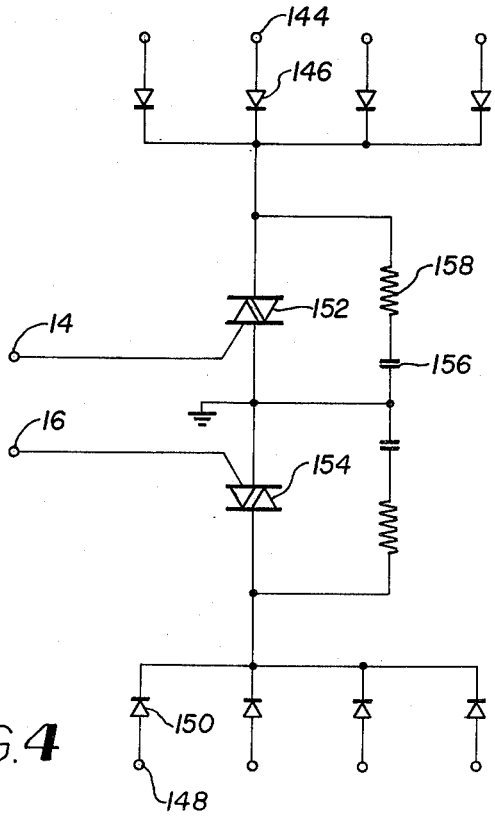
FIG. 4

FIG. 2
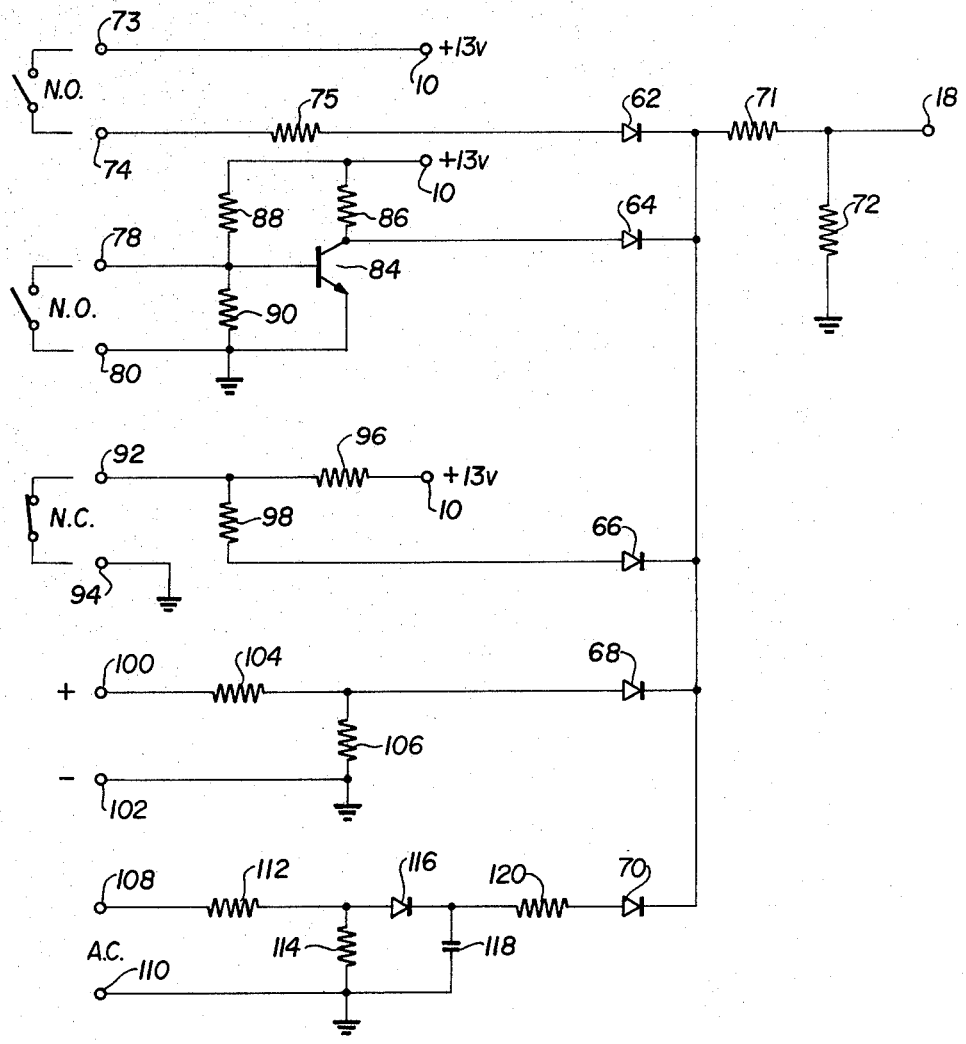
FIG. 5
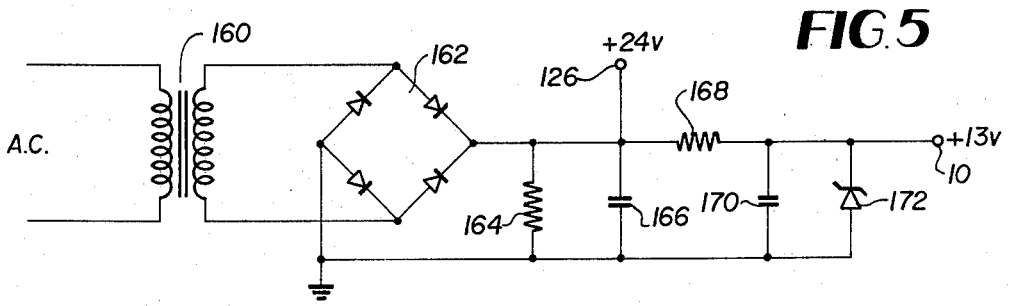
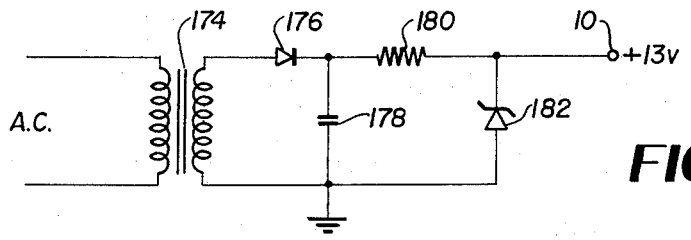
FIG. 6

INTERFACE DEVICE FOR REMOTE CONTROL

This is a continuation of application Ser. No. 701,061, filed June 30, 1976 now abandoned.

BACKGROUND OF THE INVENTION

1. Field of the Invention

The invention relates, in general, to a remote control switching system and, in particular, to the interface of pulse actuated relays with continuous signal control devices.

2. Description of the Prior Art

Pulse activated, mechanically held relays are increasingly being used in conjunction with automatic control devices to program electric circuits on and off. However, many of these automatic control devices, such as time clocks, photocell relays, intruder alarm sensors, and fire detectors have a continuous output signal, rather than a pulse output. It has been a problem to use such automatic control devices with pulse actuated relays, especially when local and master override switches are also required, so that these relays are not continuously activated which could cause thermal problems and possibly mechanical binding.

OBJECTS AND SUMMARY OF THE INVENTION

Therefore, it is a general object of the present invention to provide an interface device for sensing the presence or absence of a continuous input signal from a continuous output control device and for producing a first momentary output signal when the continuous input signal is initiated, and for producing a second momentary output signal when the continuous input signal is removed.

It is another object of the invention to provide a complete self-contained package which provides all of the basic features of the remote control system without separate isolated components such as transformers and rectifiers, so that switches and automatic control devices can be connected to the input and relays and motor master switches can be connected to the output, to complete the system.

It is a further object of the invention to provide an interface device which includes at least one internally connected control relay with output terminals to allow the use of an external power supply and load.

It is also an object of the invention to provide an interface device which has a plurality of output circuits each of which includes an internally connected diode to protect each output circuit from feedback from another output circuit.

Still another object of the invention is to provide an interface device which includes input terminals which allow the use of either a normally open or a normally closed contact of a control device to produce an input signal to the interface device using a self-contained power supply to supply the voltage for the input signal.

It is also an object of the invention to supply input terminals which allow the use of either AC or DC input signals from an external power source.

The circuitry for the interface device which accomplishes these objects includes a power supply, a signal conditioner or decoder, an incoder and a relay driver. A standard power supply circuit is used, in which the rectified output of a control transformer is smoothed and regulated by the use of resistors, capacitors and a Zener diode connected in the circuit to produce a regulated DC output.

The decoder circuit includes a NPN transistor having a collector terminal which is connected to the positive voltage output from the power supply through a first resistor, an emitter terminal connected to ground through a second resistor, and a base terminal connected to receive a positive continuous control signal to turn on this transistor when such a signal is present, and to turn off the transistor when the control signal ceases. Also, the collector terminal is connected to one side of a first capacitor, the other side of which is connected through a resistive path to ground. Similarly, the emitter terminal is connected to ground through a second capacitor and another resistive path.

When there is no signal imposed on the transistor base terminal, the first capacitor will be charged to the full positive voltage of the power supply, with the voltage on one side being at the positive supply voltage and the voltage on the other side being at ground potential, while the second capacitor will have no voltage impressed across it. When a continuous positive signal is impressed upon the base terminal of the transistor, and the transistor is turned on, current flows from the positive voltage supply through the first resistor, through the transistor between the collector and emitter terminals, and through the second resistor to ground. Because of the voltage drop through the first resistor, the voltage impressed on the positively charged side of the first capacitor immediately drops to a lower value resulting in a negative charge on the opposite side of this capacitor which is maintained until this capacitor discharges through the transistor, the second resistor and its own resistive path to ground with the time of discharge depending on the RC constant of the discharge circuit. Simultaneously, a positive potential will be impressed on the opposite side of the second capacitor by the voltage drop across the second resistor until this second capacitor is charged through its resistive path. Thus, when this transistor is switched on, a negative pulse is passed through the first capacitor, and a positive pulse is passed through the second capacitor.

When the continuous signal applied to the base terminal of the transistor ceases, and the transistor is turned off, these pulses are reversed, that is, a positive pulse is passed by the first capacitor, and a negative pulse is passed by the second capacitor.

These pulse outputs of the encoder circuit are decoded to supply the appropriate signal to the relay driver circuit by a decoder circuit which includes two NPN transistors, both of which have their emitter terminals connected to ground and their collector terminals connected to the positive voltage supply through respective resistances. The base terminals of both transistors are positively biased to turn on these transistors by resistors connected from their base terminals to their respective emitter and collector terminals. Also, the base terminal of each of these transistors is connected through a resistor to the opposite side of a respective one of the two encoder circuit capacitors, that is, on the side of these capacitors which receive a positive or negative pulse each time the encoder circuit transistor is switched. Thus, the negative pulse passed by either of the two capacitors will negatively bias the base of the respective transistor connected to that capacitor for the duration of the pulse, momentarily switching off this transistor. When this transistor is switched on, the voltage at its collector terminal is very low, being only the voltage drop between the emitter and collector terminals, with most of the supply voltage being impressed across the resistor between this terminal and the positive supply. However, when this transistor is switched off momentarily by the negative pulse impressed upon its base terminal, the voltage at the collector terminal will greatly increase to produce a positive voltage pulse which is utilized as either an "on" or an "off" momentary control signal for the relay drivers, which in turn, momentarily activate either the "on" or "off" coils of the remote control relays or motor masters connected to the output of the interface device. Thus, when a continuous input signal is applied to the base of the decoder circuit transistor, a first one of the encoder circuit transistors is momentarily switched off to produce a momentary "on" control signal; when this continuous signal ceases, the second one of the encoder circuit transistors is momentarily switched off to produce a momentary "off" control signal.

The "off" and "on" relay drivers can be either transistors or thyristors, such as SCRs or triacs. The "on" relay driver is momentarily turned on by the "on" signal produced by the encoder to energize the "on" coil of the control relays. Similarly, the "on" relay driver is momentarily turned on by the "off" signal produced by the encoder to energize the "off" coil of the control relays.

The invention will be better understood and as other objects and advantages thereof will become more apparent from the following detailed description of the invention taken in conjunction with the drawings.

BRIEF DESCRIPTION OF THE DRAWINGS

FIG. 1 is a schematic diagram of the decoder and encoder circuits of the invention.

FIG. 2 is a schematic diagram showing various input circuit and terminal arrangements.

FIG. 3 is a schematic diagram of one embodiment of the relay driver circuits of the invention.

FIG. 4 is a schematic diagram of another embodiment of the relay driver circuits of the invention.

FIG. 5 is a schematic diagram of a power supply circuit of the invention.

FIG. 6 is a schematic diagram of another type of power supply circuit of the invention.

DESCRIPTION OF PREFERRED EMBODIMENTS

Referring now to FIG. 1, there is shown five input or output terminals to the decoder and encoder circuit. These include a terminal or line 10 connected to a positive DC voltage from a power supply, a ground terminal 12, an output terminal 14 for supplying an "on" signal to the relay drivers, and output terminal 16 for supplying an "off" signal to the relay drivers, and an input terminal 18 to which is supplied a continuous signal from a remote control device. A decoder NPN transistor 20, and two encoder NPN transistors 22 and 24 all have their collector terminals connected to the positive DC supply 10 through respective resistors 26, 28 and 30. The emitter terminal of the decoder transistor 20 is connected to ground through a resistor 32, and the emitter terminals of the two encoder transistors 22 and 24 are both connected directly to ground. The base of the transistor 22 has a positive bias voltage applied to it to turn on this transistor by a resistor 34 connected between the base of this transistor 22 and ground and a resistor 36 connected between the base of this transistor 22 and the positive DC voltage supply 10. The base of the transistor 24 is similarly biased to turn on this transistor 24 by a resistor 38 connected from the base of this transistor 24 to ground and a resistor 40 connected from the base of this transistor 24 to the positive DC supply 10. Also, the base of the transistor 22 is connected through a resistor 42 to one side of a capacitor 44, the other side of which is connected to the collector terminal of the decoder transistor 20. The base of the transistor 24 is connected through a resistor 46 to one side of a capacitor 48, the other side of which is connected to the emitter of the decoder transistor 20. The base of the decoder transistor 20 is connected through a resistor 50 to the terminal 18 to receive a continuous positive signal from the input section of the control device.

When no positive signal is impressed on the base of the decoder transistor 20, this transistor will be turned off and the capacitor 44 will be charged to the full voltage of the positive voltage supply 10, while the capacitor 48 will be almost completely discharged. When a positive signal appears at the base of the decoder transistor 20, this transistor will be switched on, thus allowing current to flow from the positive voltage supply 10 through the resistor 26, through the decoder transistor 20 between its collector and emitter terminals, and through the resistor 32 to the ground terminal 12. The voltage at the collector terminal of the decoder transistor 20, and on the side of the capacitor 44 which is connected to this collector terminal, will immediately drop because of the voltage drop across the resistor 26 between the collector terminal of the transistor 20 and the positive voltage supply 10. Since initially the capacitor 44 is fully charged, a negative voltage will be impressed upon the side of this capacitor which is connected to the base terminal of the transistor 22, thus cutting off this transistor until the capacitor 44 has discharged through the decoder transistor 20, resistor 32, resistor 34, and resistor 42.

When the transistor 22 is switched on, there is very little voltage impressed upon the output terminal 14, since it is connected directly to ground through the transistor 22. However, when the transistor 22 is switched off, the voltage impressed on terminal 14 will suddenly rise to a value approaching that of the positive DC supply 10, and return to a very low value when the transistor 22 is again switched on after the capacitor 44 has discharged.

At the same time that a negative voltage is impressed upon the base of the transistor 22 when the decoder transistor 20 is switched on, a positive voltage will be impressed upon the base of the transistor 24, until the capacitor 48 is fully charged by the voltage drop across the resistor 32. Since this transistor 24 is already switched on, this additional positive bias on its base terminal will have no effect except to drive it further into saturation, and the voltage at terminal 16 will remain at a value close to ground potential.

When the voltage signal applied to the base of the decoder transistor 20 ceases, this transistor 20 will switch back to its non-conductive state, thus causing the voltage at the collector terminal of this decoder transistor 20 and the side of the capacitor 44 connected to this collector terminal, to suddenly rise to the value of the positive DC voltage supply 10. This produces a positive voltage on the opposite side of the capacitor 44 which is connected to the base of the transistor 22 through the resistor 42, but since this transistor 22 is already in its conductive state, there will be no change in the voltage output at terminal 14. However, when the decoder transistor 20 is suddenly switched off, the voltage at the emitter terminal of the decoder transistor 20, and on the side of the capacitor 48 connected to this emitter terminal, will be suddenly lowered to ground potential. This will impress a momentary negative voltage on the opposite side of the capacitor 48 which is connected to the base of the transistor 24 through the resistor 46, which will switch this transistor 24 to its non-conductive state, thus causing the voltage on the terminal 16 to suddenly rise from a value near ground potential to a value approaching that of the positive DC supply 10. After the capacitor 48 has been discharged through the resistors 32, 38 and 46, the transistor 24 is again switched to its conducting state via the bias resistors 38 and 40, and the voltage at terminal 16 again drops to a value approaching the ground potential.

Thus, each time a positive continuous signal is applied to terminal 18 of this circuit, a momentary pulse signal appears at terminal 14, and each time the continuous signal applied at terminal 18 ceases, a pulse output signal appears at terminal 16.

Since the positive pulses applied to the bases of the transistors 22, 24 during the switching of the decoder transistor 20 serve no useful purpose, these positive pulses can be by-passed to ground through diodes 51, 52 which are connected to the sides of the capacitors 44, 48 which receive this positive pulse to ground, as shown by dashed lines in FIG. 1. Also, a faster turn off of the transistors 22 and 24 can be achieved by using two additional capacitors 54, 56 connected in parallel with the diodes 51, 52 as shown by dashed lines in FIG. 1. When the decoder transistor 20 is switched on, a negative pulse will be transmitted through the capacitor 44 to charge the capacitor 54, which will then discharge through the circuit consisting of the resistors 42 and 34. Similarly, when the decoder transistor 20 is turned off, a negative pulse will be passed through the capacitor 48 to negatively charge the capacitor 56, which will then discharge through the resistors 46 and 38. Also, if desired, a Zener diode 60 can be connected between the base and emitter terminals of the decoder transistor 20, as shown by dashed lines in FIG. 1, to protect this transistor against transient voltage spikes.

Five sets of input terminals and circuits are shown in FIG. 2, for connecting the decoder and encoder circuit of FIG. 1 to different types of remote control devices. Each of these five input circuits are isolated one from another by the diodes 62, 64, 66, 68 and 70, and the output signal from each circuit is applied to a voltage divider consisting of the resistors 71 and 72, which are connected in series to ground. The signal input terminal 18 is connected to the juncture of the resistors 71, 72.

A control device having a normally open contract can be connected across the input terminals 73, 74 to connect the positive DC voltage supply 10 through the resistor 75 and diode 62 across the voltage divider 71, 72 to ground, and thus supply a continuous signal to the input terminal 18 to the decoder and encoder circuit. When these terminals 73, 74 are used, it is necessary to run a line from each terminal to a respective one of the contacts of the control device. However, if a control device with the normally open contact is connected across the input terminals 78, 80, then since the terminal 80 is connected to ground, only one line will be needed to connect the control device to the interface device, since one of the contacts can be grounded to complete the circuit. In this input circuit, the collector terminal of an NPN transistor 84 is connected through a resistor 86 to the positive voltage supply 10, and the emitter terminal of this transistor 84 is connected to ground. The base terminal of the transistor 84 is connected to the terminal 78, and normally is biased to turn-on the transistor 84 by biasing resistors 88 and 90, which are connected between the base terminal of the transistor 84 and the positive voltage supply 10, and between the base terminal and ground, respectively. When the normally open contact of the control device is closed, the base terminal of the transistor 84 is connected to ground, and the transistor switches to its nonconductive state. This allows a continuous positive voltage to be impressed across the voltage divider, 71, 72 to ground from the positive voltage supply 10 through the resistor 86 and diode 64, as long as the normally open control contact remains closed.

A normally closed contact of a remotely located control device can be connected across the input contacts 92, 94 to apply a continuous positive voltage across the voltage divider 71, 72 from the positive voltage supply 10, through the resistor 96, the resistor 98 and the diode 66 when the normally closed contact is opened. When this contact is closed, no voltage will be applied to the voltage divider 71, 72 since the common juncture of the resistors 96, 98 is connected to ground through this closed control contact.

A DC control voltage can be applied across the terminals 100, 102 to thus apply a continuous voltage across the voltage divider 71, 72 through the diode 68 by means of another voltage divider consisting of the resistors 104, 106 connected in series between the positive terminal 100 to the ground terminal 102. The diode 68 is connected to the common juncture of the resistors 104, 106 so that the voltage across the resistor 106 is applied to the voltage divider 71, 72.

An AC control signal voltage can be applied across the terminals 108, 110 to impress a continuous positive voltage across the voltage divider 71, 72. This circuit includes a voltage divider consisting of the resistors 112 and 114 connected across the input terminals 108, 110. A diode 116 is connected at the common juncture of these resistors 112, 114 to rectify the voltage impessed across the resistor 114. Finally, a capacitor 118 is connected to the D.C. output of the diode 116 and to ground, and this arrangement of elements produces a continuous D.C. voltage which is applied across the voltage divider 71, 72 through the resistor 120 and the diode 70.

Any combination of these input circuits can be built into the interface device, depending upon the type of control devices or signals to be used with the interface device. Also, more than one input circuit can be used simultaneously with the limitation that an "on" signal from any input circuit will override any "off" signal from another input circuit.

Referring now to FIG. 3, an output "on" pulse terminal 122, and a output "off" pulse terminal 124 is shown, also terminal 126 is shown for connection to a positive DC voltage supply for an internally mounted pulse actuated relay. NPN transistors 128, 130 are connected in a Darlington arrangement to amplify the positive "on" pulse produced at the terminal 14 of the encoder circuit shown in FIG. 1, with the base terminal of transistor 128 being connected to the terminal 14, the base terminal of the transistor 130 being connected to the emitter terminal of the transistor 128, the emitter terminal of transistor 130 being connected to ground, and the connector terminals of both transistors 128, and 130 being connected to the terminal 122. The terminal 122 is externally connected through the "on" coil of at least one pulse activated, mechanically held relay (now shown) to a positive DC voltage supply. Preferably the relay driver transistor 130 is of sufficient capacity to simultaneously actuate a plurality of these relays, or motor master switches. Similarly, two NPN transistors 132,134 are connected in a Darlington arrangement to amplify the positive "off" pulse produced at terminal 16 of the encoder circuits shown in FIG. 1, with the emitter terminal of transistor 134 being connected to ground and the collector terminals of both transistors 132, 134 being connected to the terminal 124. This terminal 124 is externally connected through the "off" of the above-mentioned pulse activated, mechanically held relays, to a positive DC voltage supply. When a plurality of relays are pulse actuated by this interface device, a plurality of output terminals 122, 124 can be used, and each output circuit isolated from every other output circuit by means of a diode, as described hereinafter in connection with FIG. 4.

Also shown in FIG. 3 is the "on" coil 136, and the "off" coil 138 of an integral pulse actuated, mechanically held relay. Reverse connected diodes 140, 142 can be connected across the coils 136, 138, respectively, to suppress any inductive transients when switching these coils.

When a positive pulse is applied to terminal 14, the relay driver transistor 30 is switched to its conducting state, for the duration of the pulse, which should be on the order of four to five seconds. During the time that this transistor 130 is switched on, current will flow from the DC power source 126 through the "on" coil of the relay mounted integral with the interface device and through the transistor 130 to ground. The "on" coils of the external relays connected to the terminal 122 will be similarly activated.

When a positive "off" pulse is applied to terminal 16, the relay driver 134 is switched on momentarily, and the "off" coils of both the internal pulse activated relay and the external relays connected to terminal 124 will be activated. In some cases, it may be desirable to mount several of these pulse actuated, mechanically held relays within this interface device.

In FIG. 4, four output "on" signal terminals 144 are illustrated, with each terminal 144 being connected to one side of a triac semiconductor switching device 152 through a diode 146, which assures isolation of each output circuit. Similarly, four output "off" signal terminals 148 are shown, with each terminal 148 being connected to one side of another triac semiconductor switching device 154 through a diode 150 to assure isolation of each output circuit from any other output circuit. The terminals 144 are connected to a positive DC voltage supply through the "on" coil of a remotely located pulse actuated mechanically held relay (not shown). In like manner, the output "off" signal terminals 148 are connected through the "off" coils of pulse actuated mechanically held relays to a positive DC voltage supply. The opposite side of each of the triacs 152, 154 is connected to ground. The terminal 14 is connected to the gate terminal of the triac 152, to switch this triac 152 on whenever a positive "on" pulse appears at terminal 14. Similarly, the gate of the triac 154 is connected to terminal 16, to switch on the triac 154 whenever a positive "off" pulse appears at the terminal 16. Both of the triacs 152, 154 include a snubber turn-off circuit which consists of a capacitor 156 and a resistor 158 connected in series across the power terminals of the triac 152, 154.

FIG. 5 illustrates a power supply circuit of this interface device which can be used when a pulse actuated relay is integrally mounted with the interface device, such as is shown in FIG. 3. The secondary winding of a control transformer 160 is connected to the AC inputs of a single phase, four way rectifier bridge 162, which has a register 164 and a capacitor 166 connected across its DC output, to thereby produce a positive DC voltage supply for the integrally mounted pulse actuated relay. This relay is connected through the terminal 126, which is connected to the positive DC output of the rectified bridge 162. The negative output of the DC bridge 162 is connected to ground. The lower positive voltage supply 10 required for the decoder and encoder circuit of the interface device is obtained by connecting the terminal 10 to terminal 126 through a resistor 168, and to ground through a capacitor 170 and to a Zener diode 172, connected in parallel with the capacitor 170.

FIG. 6 illustrates the power supply for the circuits of the interface device which can be used when all of the pulse actuated relays are mounted external to the interface device. One end of the secondary winding of a control transformer 174 is grounded, and the other end is connected to one side of a rectifier 176 which produces a positive DC voltage output on its other side, which is connected to the positive voltage supply terminal 10 through a resistor 180. A capacitor 178 is connected to the DC side of the rectifier 176 to thereby produce a better wave form for the output DC voltage. Also, a Zener diode is connected between the terminal 10 and ground to further regulate this DC voltage output. The control transformer 174 can be mounted separately from the interface device or the AC voltage required by this power supply can be furnished to several such interface devices from a single control transformer, which results in a very small compact interface device.

While only NPN transistors have been described in the description of the preferred embodiments, it will be apparent to those skilled in the art that PNP transistors could be used equally as well as the NPN transistors. Also, since the transistors described are used solely as off-on switching elements, it will be apparent that any semiconductor switching device which can be turned both on and off by gate control could be used equally as well as the transistors described herein.

What is claimed is:

1. An interface device for converting interruption of a continuous electrical signal into a momentary first electrical signal and converting initiation of a continuous electrical signal into a momentary second electrical signal thus indicating, respectively, a change from presence or from absence of said continuous signal, which includes:

means for sensing the initiation and interruption of a continuous signal;

said change sensing means including:

an NPN sensing transistor, having a collector terminal connected through a first resistor to a positive D.C. voltage supply, an emitter terminal connected through a second resistor to ground, and a base terminal connected to receive a positive base terminal control signal to indicate said continuous electrical signal and to maintain said sensing transistor to its conducting state;

means for providing a first momentary indication when the continuous control signal is initiated, and a second momentary indication when the continuous signal ceases;

a first means for responding to said first momentary indication to provide a first momentary electrical signal;

a second means for responding to said second momentary indication to provide a second momentary electrical signal;

means for supplying said continuous electrical signal to said base as a base control signal;

a first capacitor, having a first side connected to the collector terminal of said NPN sensing transistor, and a second opposite side connected through a first resistive path to ground;

a second capacitor, having a first side connected to the emitter terminal of said NPN sensing transistor, and a second opposite side connected through a second resistive path to ground; and said first and second resistive paths being commonly grounded.

2. An interface device, as described in claim 1, wherein a first change responsive means includes:

a first responding NPN transistor, having an emitter terminal connected to ground, a collector terminal connected through a first responsive circuit resistor to the positive voltage supply, and a base terminal which is connected through a first bias resistor to the positive voltage supply and through a second bias resistor to ground, so that said first responsive transistor is turned on, that is, is switched to its low impedance state by the bias voltage applied to the base terminal of said first responsive transistor through first and second bias resistors, said base terminal of said first responsive transistor also being connected through a first base resistor to the second side of said first capacitor.

3. An interface device, as described in claim 2, wherein said second change responsive means includes:

a second responding NPN transistor, having an emitter terminal connected to ground, a collector terminal connected through a second responding circuit resistor to the positive voltage supply, and a base terminal which is connected through a third bias resistor to the positive voltage supply and through a fourth bias resistor to ground, so that said second responding transistor is turned on, that is, is switched to its low impedance state by a bias voltage applied to the base terminal of said second responding transistor through said third and fourth bias resistors, said base terminal of said second responding transistor also being connected through a second base resistor to the second side of said second capacitor.

4. An interface device, as described in claim 3, which further includes: means for driving pulse actuated relays and motor master switching devices, which include:

a first thyristor having a gate terminal connected to the collector terminal of said first responding transistor, a first main terminal, and a second main terminal connected to ground;

a second thyristor having a gate terminal connected to the collector terminal of said second responding transistor, a first main terminal, and a second main terminal connected to ground; and means for turning off said first and second thyristors.

5. An interface device, as described in claim 4, which further includes:

a plurality of circuit isolating diodes;

a plurality of output "On" terminals, each connected through a respective one of the isolating diodes to said first main terminal of said first thyristor; and a like plurality of output "Off" terminals, each connected through a respective one of the isolating diodes to said first main terminal of said second thyristor.

6. An interface device, as described in claim 1, wherein said sensing means further includes:

a third capacitor having a first side connected to the second side of said first capacitor, and a second opposite side connected to ground; and a fourth capacitor having a first side connected to the second side of said second capacitor, and a second side connected to ground.

7. An interface device, as described in claim 1, wherein said sensing means further includes:

a first bypass diode, connected between the second side of said first capacitor and ground, to pass positive pulses to ground; and a second bypass diode, connected between the second side of said second capacitor and ground, to pass positive pulses to ground.

8. An interface device, as described in claim 1, wherein said sensing means includes:

switching means, actuatable by a change to said continuous signal, having a first terminal connected through a first resistor to a first output of a D.C. power supply, and a second opposite terminal connected through a second resistor to a second output of said D.C. power supply, said second output of said D.C. power supply being of opposite polarity relative to the polarity of said first output of said D.C. power supply;

means for transmitting said change signal;

a first capacitor having a first side connected to the first terminal of said switching means, and a second opposite side connected through a first resistive path to the second output of said D.C. power supply;

a second capacitor having a first side connected to the second opposite terminal of said switching means, and a second opposite side connected through a second resistive path to the second output of said D.C. power supply.

* * * * *